US006807751B2

(12) United States Patent
Han et al.

(10) Patent No.: US 6,807,751 B2
(45) Date of Patent: Oct. 26, 2004

(54) LAUNDRY DRIER

(75) Inventors: In Hee Han, Changwon-si (KR); Ju Han Yoon, Changwon-si (KR); Soo Won Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/717,609

(22) Filed: Nov. 21, 2003

(65) Prior Publication Data

US 2004/0139627 A1 Jul. 22, 2004

(30) Foreign Application Priority Data

Nov. 22, 2002 (KR) ..... P 10-2002-73135

(51) Int. Cl.[7] ..... F26B 11/02
(52) U.S. Cl. ..... 34/601; 34/603
(58) Field of Search ..... 34/601, 603; 49/463

(56) References Cited

U.S. PATENT DOCUMENTS 3,816,942 A * 6/1974 Smith ..... 34/242
4,754,556 A * 7/1988 Carr ..... 34/601

* cited by examiner

*Primary Examiner*—Kenneth Rinehart
(74) *Attorney, Agent, or Firm*—McKenna Long & Aldridge LLP

(57) ABSTRACT

An assembly between a front cabinet panel and a front support piece in a laundry drier is stably achieved, to improve work efficiency and productivity in a laundry drier fabrication process. The laundry drier has an internally mounted drum and includes a base forming a bottom of a body, a front cabinet panel forming a front side of the body, a pair of side cabinet panels forming opposing lateral sides of the body, a back cover forming a rear side of the body, a top cover covering an upper part of the body, a control panel installed on a rearward end of the top cover, and a front support piece installed behind the front cabinet panel to support a front side of the drier drum. The laundry drier further includes a first support flange extending from an upper portion of the front cabinet panel and having at least one slot formed in a central portion of the first support flange; and a second support flange extending from an upper portion of the front support piece and having at least one hooking portion formed by partially cutting through a pre-determined area of the second support flange, to bend the cut area into a hook that protrudes downward, wherein the hook of the second support flange is coupled with the slot of the front cabinet panel, to thereby pre-assemble the front support piece to the front cabinet panel.

3 Claims, 4 Drawing Sheets

LAUNDRY DRIER

This application claims the benefit of Korean Application No. 10-2002-0073135 filed on Nov. 22, 2002, which is hereby incorporated by reference.

BACKGROUND OF THE INVENTION

1. Field of the Invention

The present invention relates to a laundry drier, and more particularly, to an assembly of a front support piece to a front cabinet panel of a laundry drier.

2. Discussion of the Related Art

A laundry drier is an apparatus for drying wet objects, e.g., clothes, after washing. FIG. 1 illustrates the exterior of an exemplary laundry drier according to a related art.

Referring to FIG. 1, a drier body B essentially consists of a six-sided body of a base 1 forming a bottom, a front cabinet panel 2 forming a front side, a pair of side cabinet panels 3 forming opposing lateral sides, a back cover 4 forming a rear side, and a top cover 5 covering an upper part of the drier body. A control panel 6 is installed on the rearward end of the top cover. The laundry drier includes a laundry entrance in the front cabinet panel 2, and a door 10 is installed in the laundry entrance of the front cabinet panel 2.

There are, however, problems in the structure and construction of the above laundry drier. For example, assembly of the front cabinet panel 2 and the front support piece 7 is difficult, as demonstrated with respect to FIGS. 2 and 3, illustrating the internal constitution of an area A of FIG. 1. Typically, the assembly of the front cabinet panel 2 and front support piece 7 is performed after assembling the base 1, front cabinet panel 2, and side cabinet panels 3 to construct four sides of the drier body B.

Referring to FIGS. 2 and 3, the front support piece 7 is provided with a support flange 7*a* extending from an upper portion of its rear side and having a hook 700*a*, and the front cabinet panel 2 is provided with a support flange 2*a* extending from an upper portion of its front side and having a hook 200*a*. In a pre-assembly step, the front support piece 7 is coupled to the front cabinet panel 2 by bringing the support flange 7*a* into contact with the support flange 2*a*, so that the hook 700*a* of the front support piece is caught by the hook 200*a* of the front cabinet panel. Thereafter, screw coupling holes formed in both the front cabinet panel 2 and front support piece 7 are aligned, and screw coupling is carried out using a plurality of screws.

In such an assembly process, however, even though the hook of the front support piece 7 is caught by the hook of the front cabinet 2, the front support piece is merely hung on the front cabinet panel. Hence, the support is insubstantial and allows a lateral movement of the support piece 7. Moreover, alignment of the screw coupling holes requires human eyes, which makes for an unstable and cumbersome procedure.

SUMMARY OF THE INVENTION

Accordingly, the present invention is directed to a laundry drier that substantially obviates one or more of the problems due to limitations and disadvantages of the related art.

An object of the present invention, which has been devised to solve the foregoing problem, lies in providing a laundry drier by which assembly between the front cabinet panel and the front support piece is stably achieved to improve work efficiency and productivity in a laundry drier fabrication process.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry drier having an internally mounted drum and including a base forming a bottom of a body, a front cabinet panel forming a front side of the body, a pair of side cabinet panels forming opposing lateral sides of the body, a back cover forming a rear side of the body, a top cover covering an upper part of the body, a control panel installed on a rearward end of the top cover, and a front support piece installed behind the front cabinet panel to support a front side of the drier drum. The laundry drier further comprises: a first support flange extending from an upper portion of the front cabinet panel and having at least one slot formed in a central portion of the first support flange; and a second support flange extending from an upper portion of the front support piece and having at least one hooking portion formed by partially cutting through a predetermined area of the second support flange, to bend the cut area into a hook that protrudes downward, wherein the hook of the second support flange is coupled with the slot of the front cabinet panel, to thereby pre-assemble the front support piece to the front cabinet panel.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
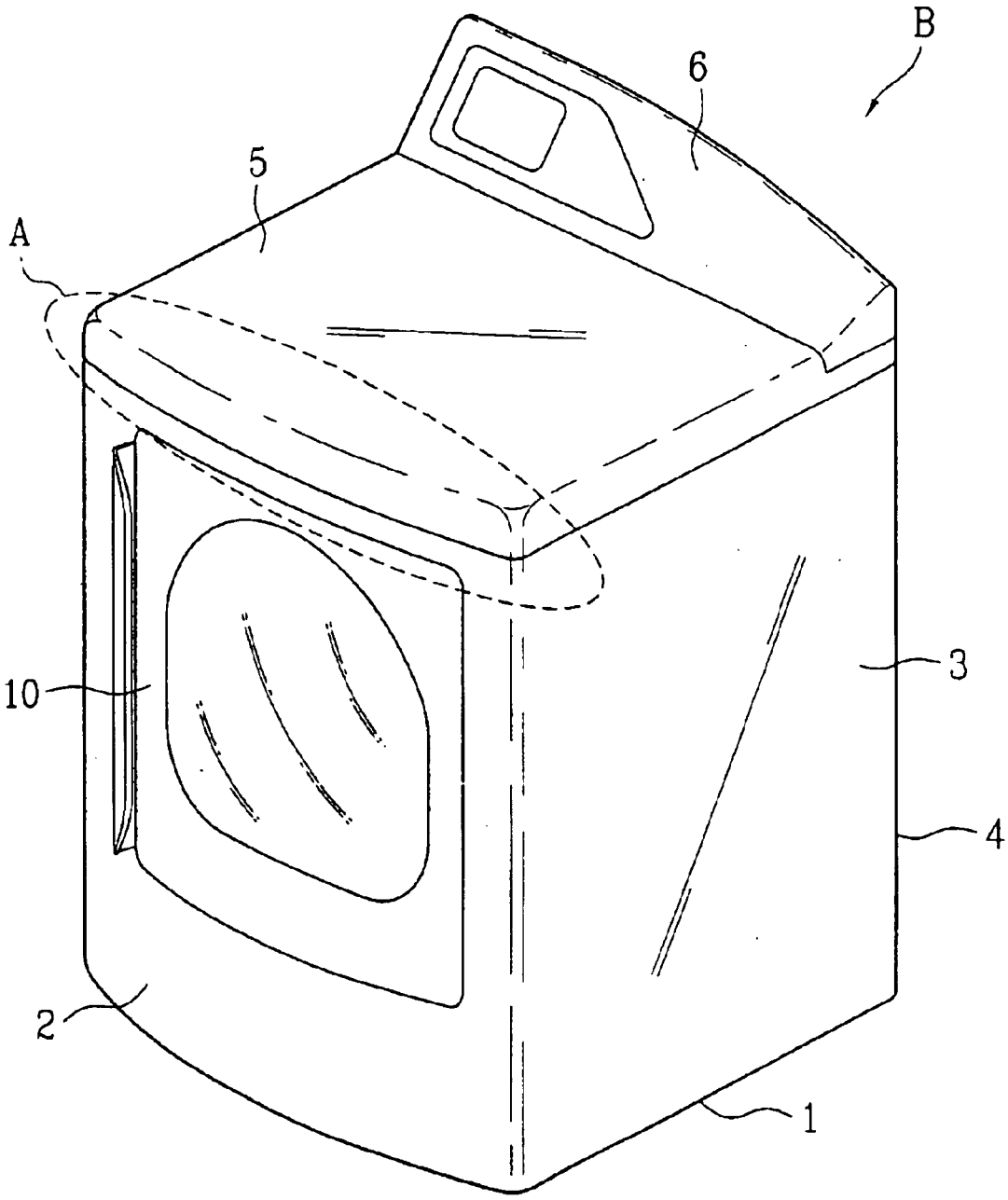
FIG. 1 Prior Art
FIG. 1 is a perspective view of an exterior of a laundry drier according to a related art.
Figure 2:
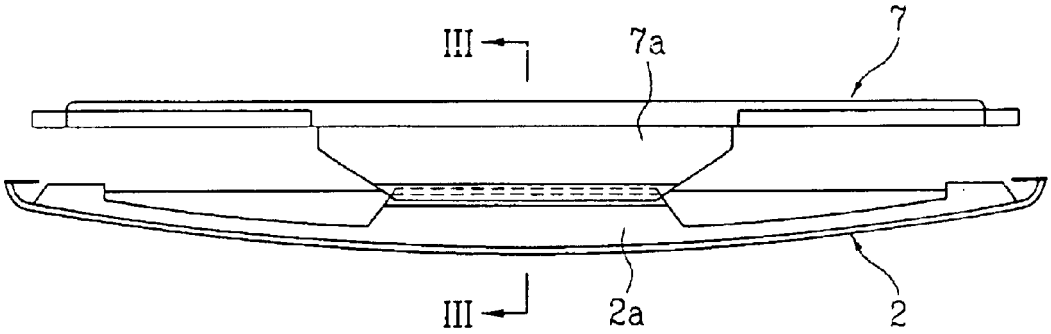
FIG. 2 Prior Art
FIG. 2 is an internal plan view of an area "A" of FIG. 1, showing the assembly of a front cabinet panel and a front support piece.
Figure 3:
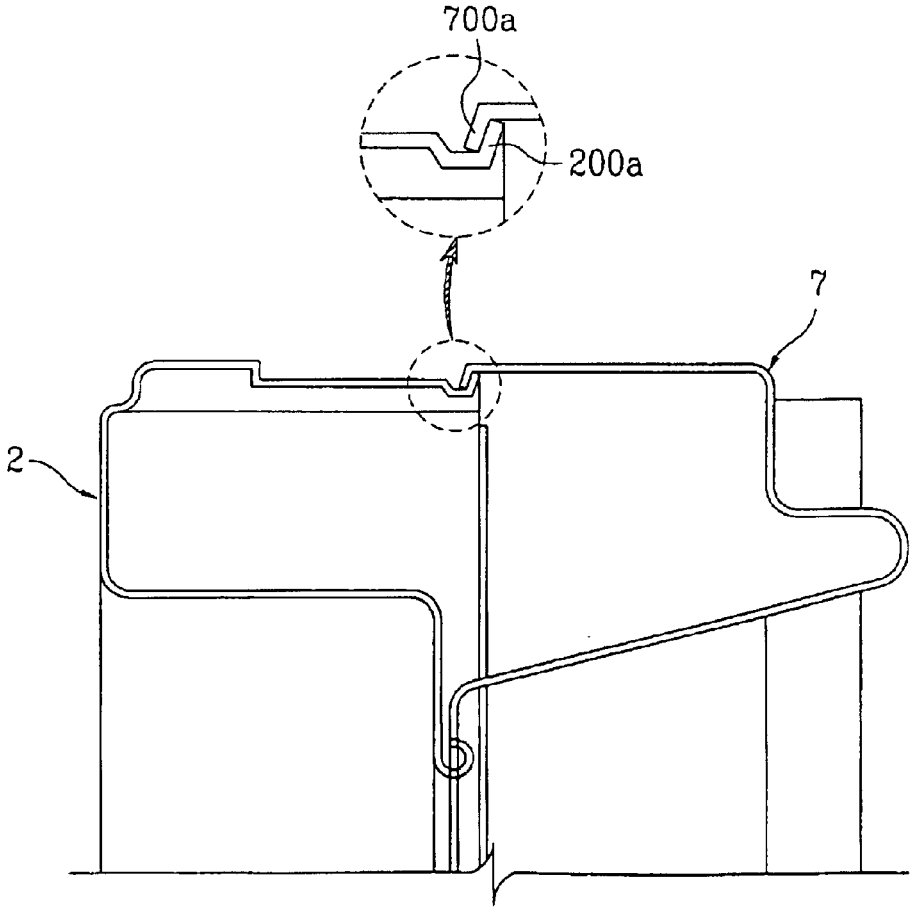
FIG. 3 Prior Art
FIG. 3 a cross-sectional view along a line III—III in FIG. 2.
Figure 4A:
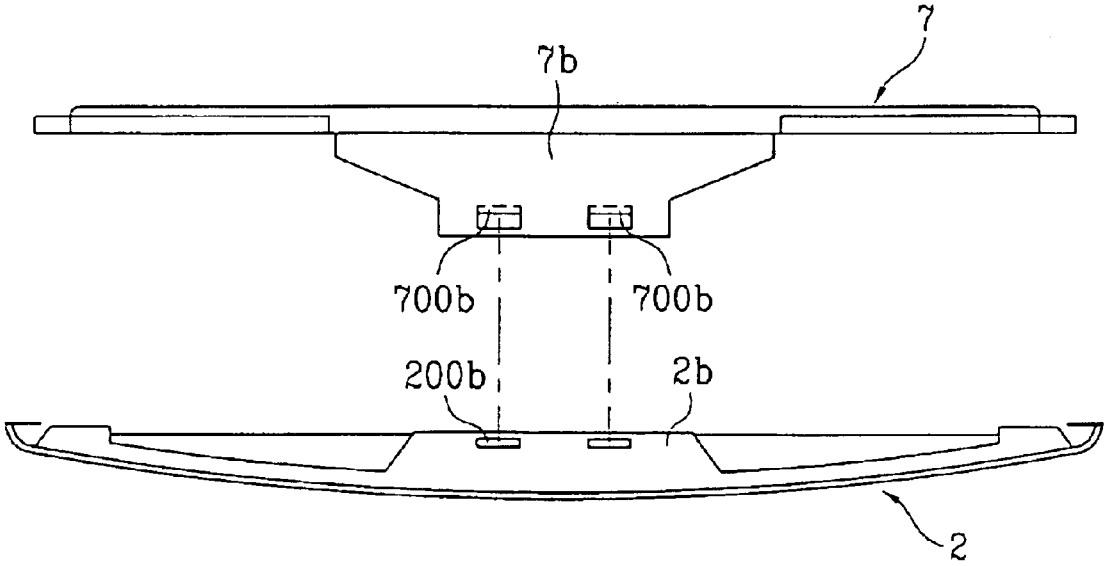
FIGS. 4A and 4B are internal plan views of an area "A" of FIG. 1, illustrating before and after assembly states of a laundry drier according to the present invention, respectively.
Figure 4B:
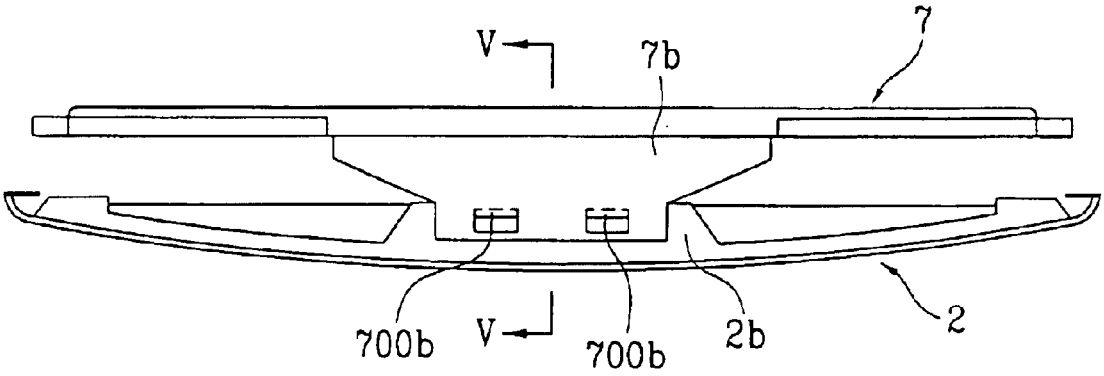

Referring to FIGS. 4A and 4B, illustrating before and after assembly states of a laundry drier according to the present invention, respectively, the laundry drier has an internally mounted drier drum and includes a base 1 forming a bottom of a drier body B, a front cabinet panel 2 forming a front side of the drier body, a pair of side cabinet panels 3 forming opposing lateral sides of the drier body, a back cover 4 forming a rear side of the drier body, a top cover 5 covering an upper part of the drier body, a control panel 6 installed on a rearward end of the top cover, and a front support piece 7 installed behind the front cabinet panel 2 to support a front side of the drier drum. The above laundry drier according to the present invention further comprises a first support flange 2*b* extending from an upper portion of the front cabinet panel 2 and having at least one slot 200*b* centrally formed and a second support flange 7*b* extending from an upper portion of the front support piece 7 and having at least one hooking portion formed by partially cutting through a predetermined area thereof, to bend the cut area into a hook 700*b* protruding downward. The hook 700*b* of the second support flange 7*b* is coupled with the slot 200*b* of the first support flange 2*b*, to thereby pre-assemble the front support piece 7 to the front cabinet panel 2. According to the present invention, the pre-assembly of the front cabinet panel 2 and front support piece 7 is such that the loose fit of the laundry drier of the related art is prevented. Preferably, at least two slots 200*b* and at least two hooks 700*b* are provided. Each hook 700*b* is formed by lancing.

In assembling a laundry drier according to the present invention, the front support piece 7 is first pre-assembled to the front cabinet panel 2 using the above-described hooks 700*b* and slots 200*b*, to fit the front support piece to the front cabinet panel securely. In doing so, there is an inherent alignment of a plurality of screw-coupling positions of the front cabinet panel 2 and front support piece 7. Therefore, the present invention provides a structure enabling a stable assembly process.

Figure 5:
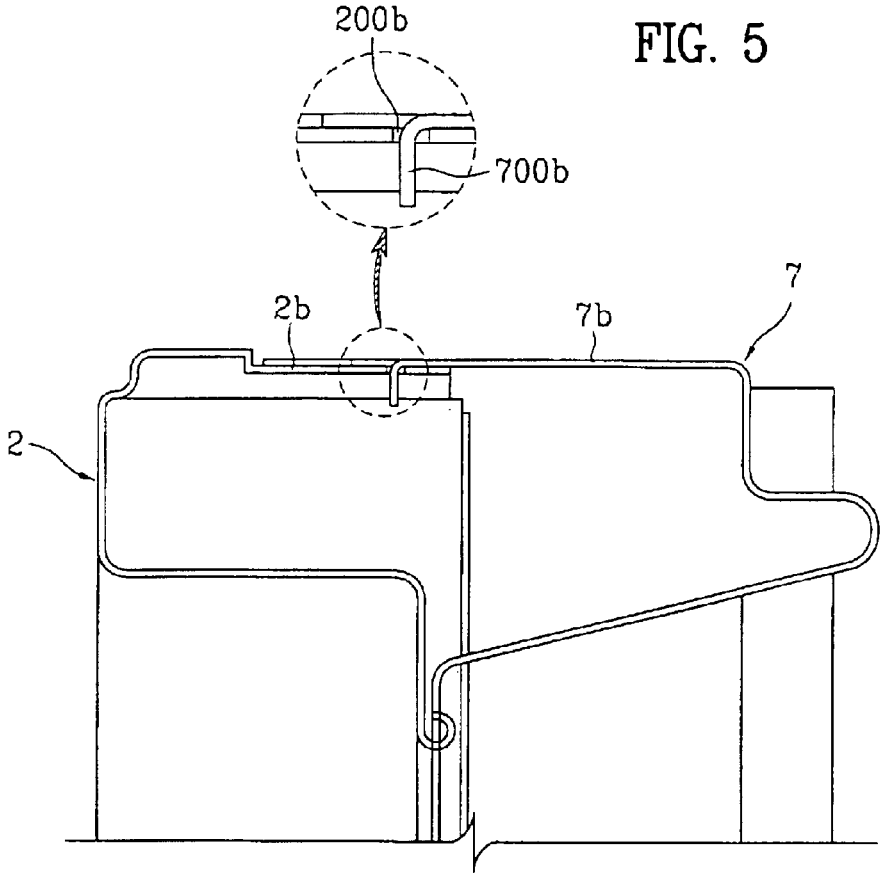
FIG. 5 is a cross-sectional view along a line V—V in FIG. 2B.
Figure 6:
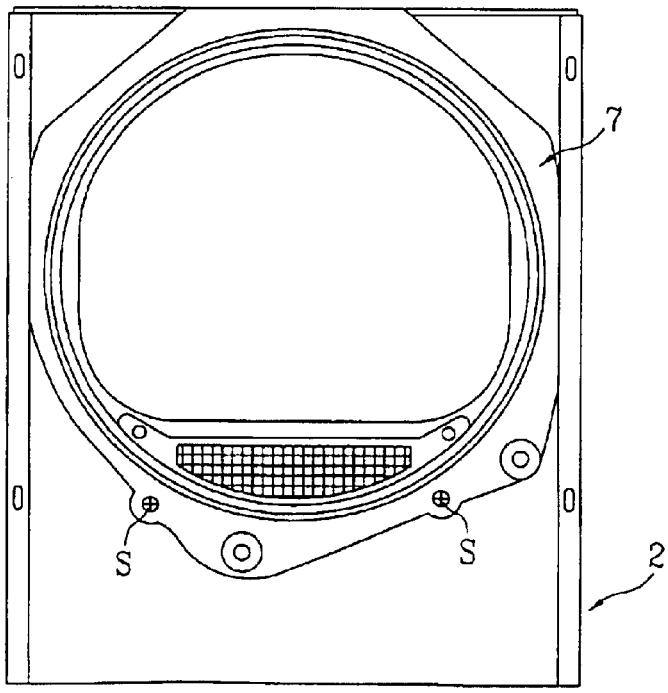
FIG. 6 is an inner side view of the assembled state shown in FIG. 2B.

In detail, the base 1, the front cabinet panel 2, and the side cabinet panels 3 are first assembled. Then, as shown in FIG. 5, the hook 700*b* of the second support flange 7*b* is inserted into the slot 200*b* of the first support flange 2*b*, to achieve a pre-assembly condition. In this condition, as shown in FIG. 6, the front support piece 7 is secured in a fixed state, such that its movement is prevented, and the coupling positions for a plurality of screws S are automatically aligned by a predetermined positioning of the slots 200*b* and hooks 700*b* with respect to the desired state of the completed assembly.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry drier having an internally mounted drum and including a base forming a bottom of a body, a front cabinet panel forming a front side of the body, a pair of side cabinet panels forming opposing lateral sides of the body, a back cover forming a rear side of the body, a top cover covering an upper part of the body, a control panel installed on a rearward end of the top cover, and a front support piece installed behind the front cabinet panel to support a front side of the drier drum, the laundry drier further comprising:

a first support flange extending from an upper portion of the front cabinet panel and having at least one slot formed in a central portion of said first support flange; and a second support flange extending from an upper portion of the front support piece and having at least one hooking portion formed by partially cutting through a predetermined area of said second support flange, to bend the cut area into a hook that protrudes downward, wherein the hook of said second support flange is coupled with the slot of the front cabinet panel, to thereby pre-assemble the front support piece to the front cabinet panel.

2. The laundry drier as claimed in claim 1, wherein each hook is formed by lancing.

3. The laundry drier as claimed in claim 1, wherein said first support flange has at least two slots and said second support flange has at least two hooks.

* * * * *